US007330162B2

(12) United States Patent
Yamazaki et al.

(10) Patent No.: US 7,330,162 B2
(45) Date of Patent: Feb. 12, 2008

(54) METHOD OF DRIVING A LIGHT EMITTING DEVICE AND ELECTRONIC EQUIPMENT

(75) Inventors: Yu Yamazaki, Tokyo (JP); Ryota Fukumoto, Kanagawa (JP); Yoshifumi Tanada, Kanagawa (JP); Tomoyuki Iwabuchi, Kanagawa (JP); Satoshi Seo, Kanagawa (JP); Shunpei Yamazaki, Tokyo (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 211 days.

(21) Appl. No.: 10/373,789

(22) Filed: Feb. 26, 2003

(65) Prior Publication Data

US 2003/0160746 A1 Aug. 28, 2003

(30) Foreign Application Priority Data

Feb. 28, 2002 (JP) ..... 2002-054903

(51) Int. Cl.
*G09G 3/32* (2006.01)
*G09G 3/10* (2006.01)

(52) U.S. Cl. ..... 345/0.82; 345/76; 345/209; 345/690; 315/169.1; 315/169.3

(58) Field of Classification Search ..... 345/76, 345/77, 79, 82, 209, 690; 315/169.1, 169.3, 315/169.4
See application file for complete search history.

(56) References Cited

U.S. PATENT DOCUMENTS 5,247,190 A 9/1993 Friend et al. ..... 257/40
5,272,471 A 12/1993 Asada et al. ..... 345/149
5,399,502 A 3/1995 Friend et al. ..... 437/1
5,594,569 A 1/1997 Konuma et al. ..... 349/122

(Continued)

FOREIGN PATENT DOCUMENTS

EP 1 031 961 8/2000

(Continued)

OTHER PUBLICATIONS

Inui, S. et al, " Thresholdless Antiferroelectricity in Liquid Crystals and its Application to Displays," J. Matter Chem., vol. 6, No. 4, pp. 671-673, 1996.

(Continued)

*Primary Examiner*—Henry N Tran
(74) *Attorney, Agent, or Firm*—Cook, Alex, McFarron, Manzo, Cummings & Mehler, Ltd.

(57) ABSTRACT

A driving method is provided which improves the duty ratio, which presents high image quality by securing a sufficient length of sustain (lighting) period when gray scales are increased in number, and which prolongs the lifetime of a light emitting element. One frame period has m (m is a natural number equal to or larger than 2) different sub-frame periods $SF_1$, $SF_2$, . . . , and $SF_m$. The m different sub-frame periods $SF_1$, $SF_2$, . . . , and $SF_m$ each have an address period and a sustain period. Analog data signals are inputted to their respective light emitting elements in the address period. In the sustain period, the light emitting elements emit light in response to the analog data signals at n (n is a natural number equal to or larger than 2) levels of luminance for gray scale display.

14 Claims, 13 Drawing Sheets

U.S. PATENT DOCUMENTS

| | | | | |
|---|---|---|---|---|
| 5,643,826 | A | 7/1997 | Ohtani et al. | 437/88 |
| 5,870,075 | A | 2/1999 | Yamazaki et al. | 345/149 |
| 5,923,962 | A | 7/1999 | Ohtani et al. | 438/150 |
| 5,990,629 | A | 11/1999 | Yamada et al. | 315/169.3 |
| 6,184,874 | B1 | 2/2001 | Smith et al. | 345/204 |
| 6,292,168 | B1 | 9/2001 | Venable et al. | 345/153 |
| 6,380,689 | B1 * | 4/2002 | Okuda | 315/169.3 |
| 6,590,581 | B1 | 7/2003 | Koyama et al. | |
| 6,731,276 | B1 * | 5/2004 | Ishizuka | 345/211 |
| 6,753,854 | B1 | 6/2004 | Koyama et al. | |

FOREIGN PATENT DOCUMENTS

| | | |
|---|---|---|
| EP | 1 037 192 | 9/2000 |
| EP | 1 063 630 | 12/2000 |
| EP | 1 103 946 A2 | 5/2001 |
| JP | 7-130652 | 5/1995 |
| JP | 10-092576 | 4/1998 |
| JP | 10-214060 | 8/1998 |
| JP | 10-232649 | 9/1998 |
| JP | 10-312173 | 11/1998 |
| JP | 2000-056727 | 2/2000 |
| JP | 2000-310980 | 11/2000 |
| JP | 2000-330527 | 11/2000 |
| JP | 2000-347634 | 12/2000 |
| JP | 2000-347636 | 12/2000 |
| JP | 2001-005426 | 1/2001 |
| JP | 2001-013908 | 1/2001 |
| JP | 2001-027891 | 1/2001 |
| JP | 2001-109432 | 4/2001 |
| JP | 2001-343933 | 12/2001 |
| JP | 2001-109432 | 4/2002 |
| WO | WO 90/13148 | 11/1990 |

OTHER PUBLICATIONS

Yoshida, T. et al, "A Full-Color Thresholdless Antiferroelectric LCD Exhibiting Wide Viewing Angle with Fast Response Time," SID 97 Digest, pp. 841-844, 1997.

Furue, H. et al, "Characteristics and Driving Scheme of Polymer-Stabilized Monostable FLCD Exhibiting Fast Response Time and High Contrast Ratio with Gray-Scale Capability," SID 98 Digest, pp. 782-785, 1998.

Schenk, H. et al, "Polymers for Light Emitting Diodes," EURODISPLAY '99, Proceedings of the 19th International Display Research Conference, Sep. 6-9, 1999, Berlin, Germany, pp. 33-37, 1999.

English abstract re Japanese patent application No. 7-130652, published May 19, 1995.

English abstract re Japanese patent application No. 10-092576, published Apr. 10, 1998.

English abstract re Japanese patent application No. 10-214060, published Aug. 11, 1998.

English abstract re Japanese patent application No. 10-232649, published Sep. 2, 1998.

English abstract re Japanese patent application No. 10-312173, published Nov. 24, 1998.

English abstract re Japanese patent application No. 2000-310980, published Nov. 7, 2000.

English abstract re Japanese patent application No. 2000-330527, published Nov. 30, 2000.

English abstract re Japanese patent application No. 2000-347634, published Dec. 15, 2000.

English abstract re Japanese patent application No. 2000-347636, published Dec. 15, 2000.

English abstract re Japanese patent application No. 2001-013908, published Jan. 19, 2001.

English abstract re Japanese patent application No. 2001-027891, published Jan. 30, 2001.

English abstract re Japanese patent application No. JP 2001-005426.

English abstract re Japanese patent application No. JP 2001-109432.

* cited by examiner

501 : SHIFT REGISTER
502 : FIRST LATCH CIRCUIT
503 : SECOND LATCH CIRCUIT
504 : D/A CONVERTER
510 : FLIP-FLOP

611 : SHIFT REGISTER
612 : BUFFER
613 : PULSE WIDTH CONTROL CIRCUIT
614 : FLIP-FLOP
615 : NAND

901: SUBSTRATE
902: OPPOSED SUBSTRATE
903: PIXEL PORTION
904: SOURCE SIGNAL LINE DRIVING CIRCUIT
905,906: GATE SIGNAL LINE DRIVING CIRCUIT
907: FPC

METHOD OF DRIVING A LIGHT EMITTING DEVICE AND ELECTRONIC EQUIPMENT

BACKGROUND OF THE INVENTION

1. Field of the Invention

The present invention relates to a driving method of a light emitting device having a light emitting element on the substrate. Especially, it relates to the driving method of a light emitting device in which an operation of the light emitting element is controlled by using a semiconductor device (a device using a semiconductor thin film).

2. Description of the Related Art

Recently, techniques for forming a TFT on a substrate has been greatly advanced, and much developments have been made to apply those techniques to an active-matrix type display device. In particular, a TFT employing a poly silicon film can operate at a higher speed since a field effect mobility (simply referred to as the mobility) thereof is larger than that of a TFT employing the conventional amorphous silicon film. Thus, it becomes possible to control pixels by means of a driver circuit formed on the same substrate as the pixels. Such the pixels were conventionally controlled by means of a driver circuit provided at the outside of the substrate.

The active-matrix type display device as mentioned above can exhibit various advantages such as a reduced fabricating cost, miniaturization of the display device, an increased fabricating yield, a reduced throughput or the like, by providing various circuits and devices on the identical substrate.

Furthermore, researches of an active-matrix type light emitting device having light emitting elements have been actively conducted. Such a light emitting device is also referred to as an Organic EL Display (OELD) or an Organic Light Emitting Diode (OLED).

In the present specification, the EL element that is a light emitting element formed in the pixel of an organic light emitting device is described as an example of a typical light emitting element.

Unlike a liquid crystal display device, the light emitting device is of the self-emission type. An EL element has a structure that the light emitting layer is placed between a cathode and an anode, but a light emitting layer usually has a laminated structure. Typical examples therefore include a laminated structure of "a hole transportation layer/an organic compound layer/an electron transportation layer" proposed by Tang et al. of Eastman Kodak Co. This structure has a high luminous efficiency, and most of light emitting devices about which research and development activities are currently being progressed employ this structure.

Alternatively, a laminated structure in which a hole injection layer/a hole transportation layer/an organic compound layer/an electron transportation layer, or a hole injection layer/a hole transportation layer/an organic compound layer/an electron transportation layer/an electron injection layer are formed in these orders may be used. Furthermore, fluorescent dyes or the like may be doped into the organic compound layer.

In the present specification, all of the layers to be disposed between the cathode and the anode are collectively referred to as the light emitting layer. Accordingly, all of the above-mentioned layers such as the hole injection layer, the hole transportation layer, the organic compound layer, the electron transportation layer, the electron injection layer or the like are included in the light emitting layer.

A predetermined voltage is applied to the light emitting layer made of the above-mentioned structure via the pair of electrodes, and thus recombination of carriers occurs in the light emitting layer, thereby resulting in light emission. In the present specification, when the EL element emits light, the EL element is expressed as being driven.

3. Problems to be Resolved by the Invention

Known gray scale display methods for light emitting devices are divided into analog methods and digital time division methods.

Analog gray scale display of a light emitting device is described with reference to FIGS. 1 and 2.

FIG. 1 shows the structure of a pixel portion 1800 of a light emitting device. The pixel portion is composed of (x x y) (x and y are natural numbers equal to or larger than 1) pixels arranged to form a matrix pattern. Gate signals are input to y gate signal lines ($G_1$ to $G_y$), which are each connected to a gate electrode of a switching TFT 1801 of each pixel. The switching TFT 1801 of each pixel has a source region and a drain region one of which is connected to one of x source signal lines ($S_1$ to $S_x$) (also called data signal lines) to which analog video signals are input and the other of which is connected to a gate electrode of a driving TFT 1804 of each pixel.

The driving TFT 1804 of each pixel has a source region and a drain region one of which is connected to a power supply line 1810 and the other of which is connected to an EL element 1806. The power supply line 1810 is kept at a certain electric potential and this electric potential is denoted by $V_D$.

A capacitor 1808 may be provided between the gate electrode of the driving TFT 1804 and the power supply line 1810 to serve as a storage capacitor for holding the gate-source voltage of the driving TFT 1804.

The EL element 1806 is composed of an anode, a cathode, and a light emitting layer that is placed between the anode and the cathode. When the anode is connected to the source region or drain region of the driving TFT 1804, the cathode is connected to an opposite electrode 1809. On the other hand, when the cathode is connected to the source region or drain region of the driving TFT 1804, the opposite electrode 1809 is connected to the anode.

Though not shown in FIG. 1, the opposite electrode 1809 of each pixel is connected so as to have the same electric potential, which is denoted by $V_C$.

FIG. 2 is a timing chart of when the light emitting device is driven by an analog method. One frame period (F) is a period necessary to write one screen of video signals and display an image. A period in which a gate signal line on one row is selected is called one line period (L). Since the light emitting device of FIG. 1 has y gate signal lines, one frame period has y line periods ($L_1$ to $L_y$). A period from the end of selection of the gate signal line on the last row in a frame period until the start of selection of the gate signal line on the first row in the next frame period is called a vertical retrace period.

In a usual light emitting device, 60 or more frame periods are provided in one second to display 60 or more images per second. If the number of images displayed per second is less than 60, flickering of images is recognizable to the eye.

As the number of gate signal lines, y, becomes larger, line periods in one frame period are increased in number and the driving circuit has to be operated at higher frequency.

Next, how the analog drive light emitting device shown in FIG. 1 operates will be described referring to FIG. 2.

In Line Period 1 ($L_1$), a selection signal is input from a gate signal line driving circuit to the gate signal line $G_1$. Then, analog data signals are input to the source signal lines ($S_1$ to $S_x$) in order.

The selection signal turns every switching TFT 1801 that is connected to the gate signal line $G_1$ ON. Accordingly, the analog video signals input to the source signal lines ($S_1$ to $S_x$) are input to the gate electrode of the driving TFT 1804 through the switching TFT 1801.

With the switching TFT 1801 turned ON, the electric potential of an analog video signal input into the pixel changes the electric potential of the gate electrode of the driving TFT 1804. At this point, the drain current is determined uniquely from the gate-source voltage in accordance with the voltage-current characteristic of the driving TFT 1804. A desired drain current is thus supplied to the EL element 1806, which emits light at a luminance according to the amount of the drain current.

The operation described above is repeated until inputting of analog video signals to source signal lines ($S_1$ to $S_x$) is completed to end Line Period 1 ($L_1$). Alternatively, one line period may be determined consisingt of a period necessary to complete inputting of analog video signals to the source signal lines ($S_1$ to $S_x$) and a horizontal retrace period. After Line Period 1 ($L_1$), Line Period 2 ($L_2$) is started and a selection signal is input to the gate signal line $G_2$. Then, similar to Line Period 1 ($L_1$), analog video signals are input to the source signal lines ($S_1$ to $S_x$) in order.

When every gate signal line (every one of $G_1$ to $G_y$) has received a selection signal, all the line periods ($L_1$ to $L_y$) are now finished. Finishing all the line periods ($L_1$ to $L_y$) means the end of one frame period. During one frame period, every pixel is used to form an image for display. Alternative definition of one frame period is all the line periods ($L_1$ to $L_y$) plus a vertical retrace period.

The electric potential $V_D$ of the power supply line 1810 and the electric potential $V_C$ of the opposite electrode of each pixel are set to levels that allow the light emitting element to carry out the above operation normally.

As described, analog data signals control the light emission luminance of EL elements for gray scale display. This is a driving method called an analog gray scale display method, and uses an electric potential difference of analog video signals to display an image in gray scales.

If the Id-Vg characteristic of the driving TFT is fluctuated among pixels, it is impossible to output the same drain current even when the same gate-source voltage is applied to the driving TFT of each pixel. Then the slightest fluctuation in Id-Vg characteristic causes EL elements of adjacent pixels to emit light in different amounts from one another even though signals of the same voltage are input to the pixels.

Analog gray scale display is thus very responsive to characteristic fluctuation among TFTs and this is an obstacle for a light emitting device to display an image in increased gray scales.

Described next are a technique disclosed in Japanese Laid-Open Publication No. 2001-5426 A as gray scale display by a digital time division method and its problems.

In order to increase the number of gray scales without changing the length of one frame period, more sub-frame periods have to be provided in one frame period. Therefore, it is necessary to operate the circuit for sending signals to pixels at higher speed. This results in an increase in power consumption. Also, an increase in number of address (writing) periods (Ta) leads to reduction in proportion of display periods to the entire length of one frame period (duty ratio). If the sum of sustain (lighting) periods (Ts) in one frame period amounts to half the one frame period, namely, if the duty ratio is 50%, the luminance in this case is half the luminance of when the duty ratio is 100%. To obtain the same level of luminance as when the duty ratio is 100%, the luminance at which an EL element emits light in a sustain (lighting) period, namely, instantaneous luminance, has to be doubled. This means that an EL element has to receive a doubled amount of current.

SUMMARY OF THE INVENTION

The present invention has been made in view of the above problems of gray scale display methods for light emitting devices, and an object of the present invention is to improve the duty ratio by using a novel driving method as well as to present high image quality by securing a sufficient length of sustain (lighting) period when gray scales are increased in number.

In the process of reaching the present invention, the present inventors have placed the cause of the problems of analog gray scale display in the current flowing into EL elements which is readily changed in amount in response to Id-Vg characteristic fluctuation among TFTs to be controlled.

Also, the present inventors have placed the cause of the problems of digital time division gray scale display in insufficient luminance due to lowering of duty ratio which accompanies an increase in gray scale number.

Accordingly, another object of the present invention is to provide a method of displaying an image in increased gray scales without being affected by Id-Vg characteristic fluctuation among TFTs and without changing the circuit operation speed and duty ratio by combining control of the amount of current flowing into an EL element and control of the light emission time of the EL element to control the luminance of the EL element, in other words, by combining analog gray scale display and digital time division gray scale display to display an image in gray scales.

With the above structure, the present invention can reduce fluctuation in amount of current output when there is slight fluctuation in Id-Vg characteristic among TFTs and the same gate-source voltage is applied to the TFTs. Accordingly, the present invention can prevent the Id-Vg characteristic fluctuation from causing a great difference in EL element light emission amount between adjacent pixels when signals of the same voltage are input.

When the gray scale number is the same, the number of sub-frame period in the above structure is less than the sub-frame period number in digital time division gray scale display. Accordingly, the present invention can set the duty ratio high and eliminate the need to operate the circuit at high speed, thereby reducing power consumption.

In this specification, "$n^m$" or "n^m" indicates the m-th power of n.

The structure of the present invention will be described hereinbelow.

According to an aspect of the present invention, there is provided a method of driving a light emitting device, characterized in that control of an amount of current flowing into a light emitting element and control of a time in which the light emitting element emits light are combined for gray scale display.

According to another aspect of the present invention, there is provided the method of driving a light emitting device, characterized in that one frame period has m (m is a natural number equal to or larger than 2) sub-frame periods, the m sub-frame periods each have an address period and a sustain period, analog data signals are input to their respective light emitting elements in the address period, and the light emitting elements emit light at n (n is a natural number equal to or larger than 2) levels of luminance in response to the analog data signals.

According to another aspect of the present invention, there is provided the method of driving a light emitting device, characterized in that one frame period has m (m is a natural number equal to or larger than 2) sub-frame periods, the m sub-frame periods each have an address period and a sustain period, analog data signals are input to their respective light emitting elements in the address period, the light emitting elements emit light at n (n is a natural number equal to or larger than 2) levels of luminance in response to the analog data signals, and an image is displayed in $n^m$ gray scales.

The method of driving a light emitting device of the present invention is characterized in that the light emitting device has a pixel portion and the light emitting elements are placed in the pixel portion, the light emitting elements each have a first electrode and a second electrode, and the light emission luminance of the light emitting elements is controlled by an ON light emitting element driving current that flows between the first electrode and the second electrode.

The method of driving a light emitting device of the present invention is characterized in that one frame period has a period in which a bias voltage of a polarity reverse to the forward polarity is applied to the light emitting elements.

With the present invention, an electronic equipment employing the light emitting device driving method is provided.

DETAILED DESCRIPTION OF THE PREFERRED EMBODIMENTS

Detailed descriptions will be given below through embodiment modes on a method of driving a light emitting device in accordance with the present invention. However, the light emitting device driving method of the present invention is not limited to the following embodiment modes.

Embodiment Mode 1

Figure 1:
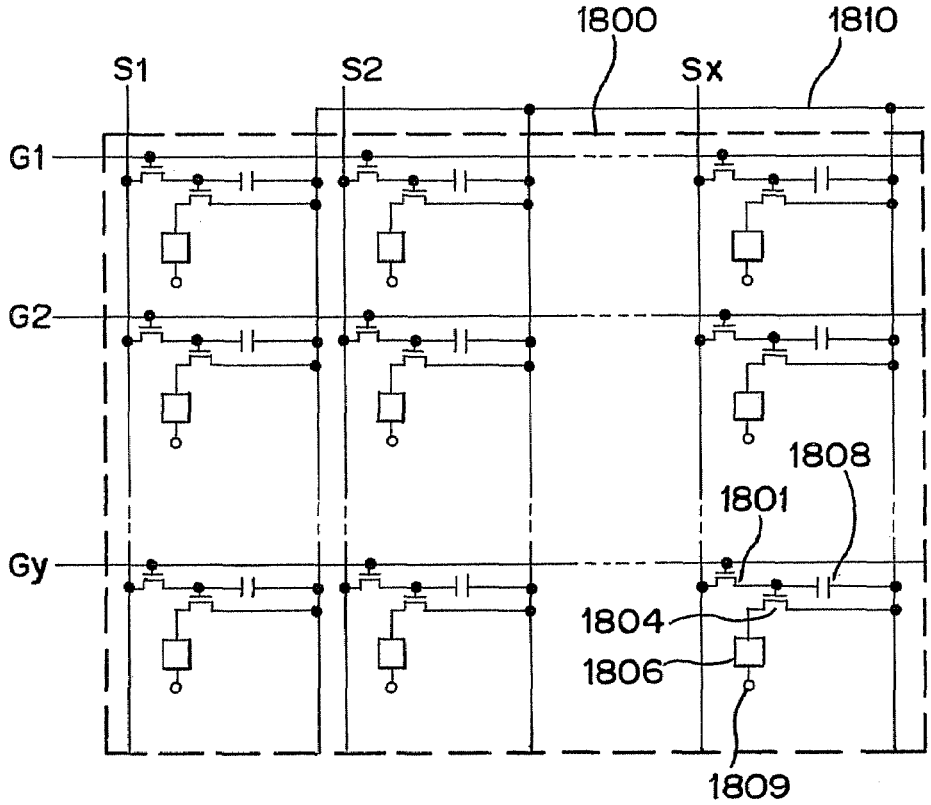
FIG. 1 PRIOR ART
FIG. 1 is a circuit diagram of a pixel portion of an analog light emitting device.
Figure 2:
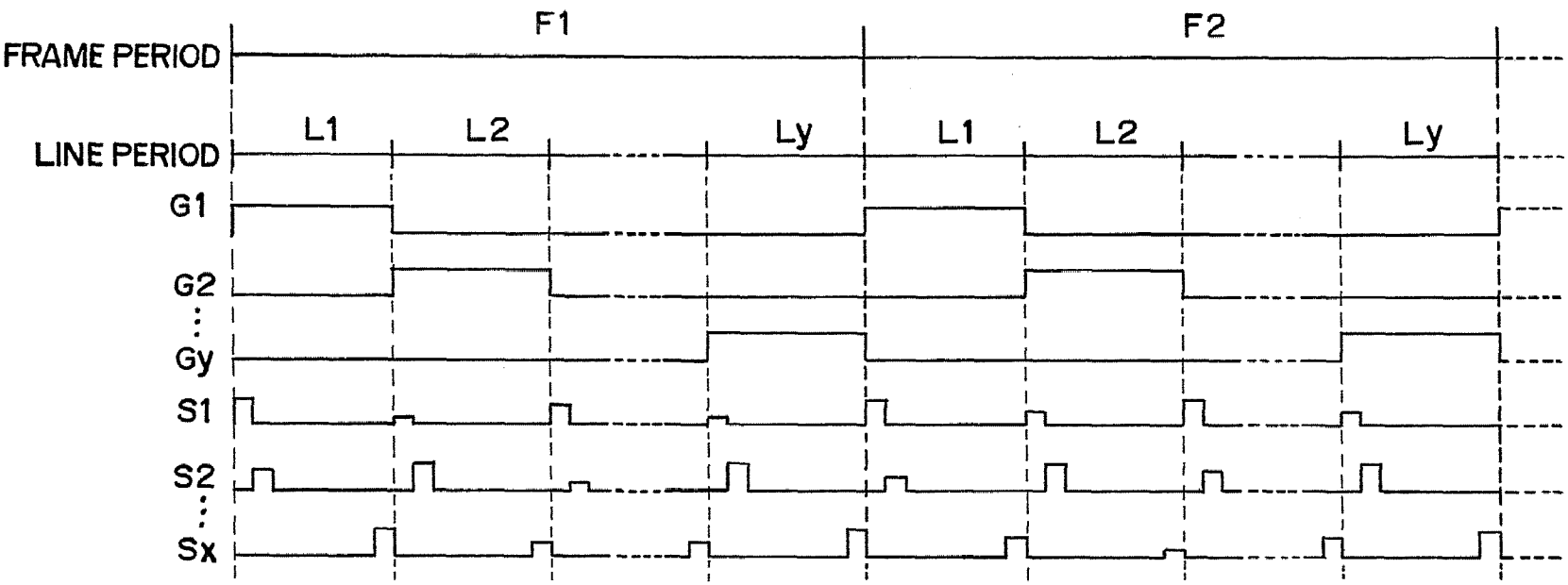
FIG.2 PRIOR ART
FIG. 2 is a timing chart of the analog light emitting device.
Figure 3:
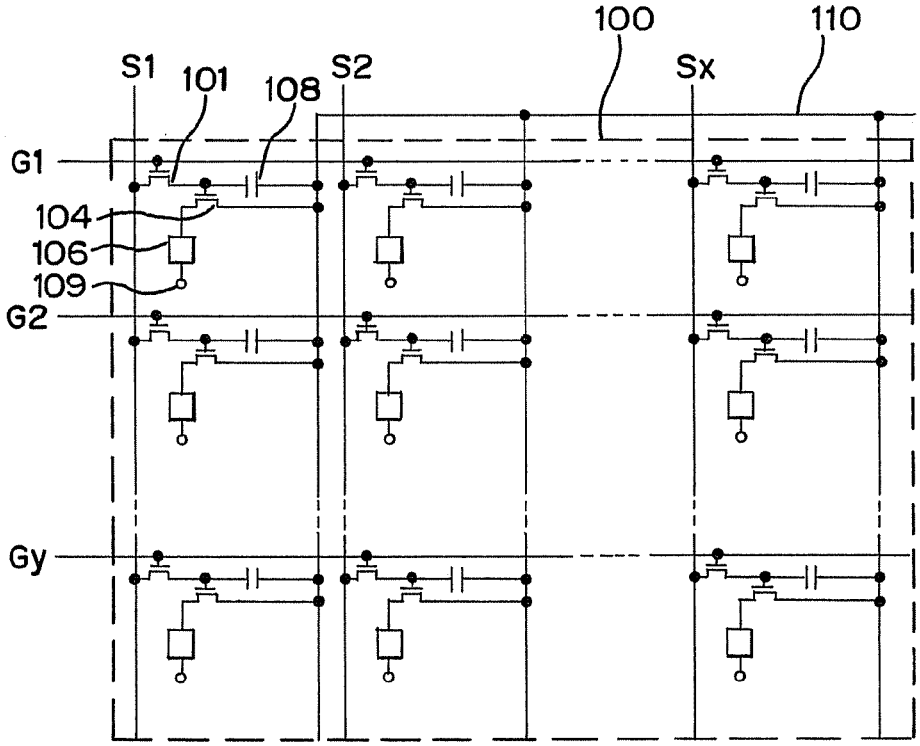
FIG. 3 is a diagram showing a circuit example of a pixel portion in a light emitting device of the present invention.
Figure 4:
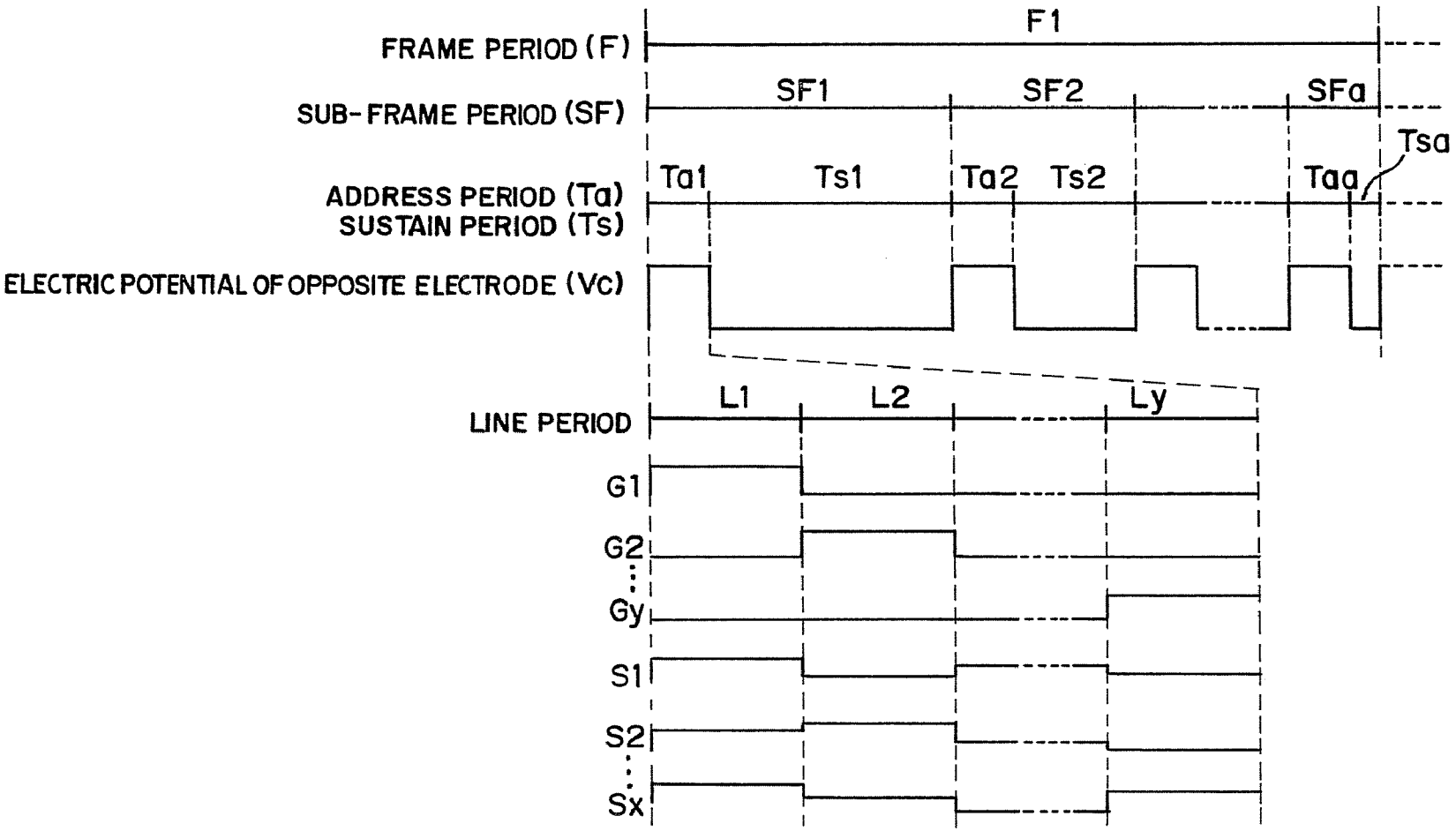
FIG. 4 is a timing chart of digital time division gray scale display of the present invention.

In this embodiment mode, a description is given with reference to FIGS. 3 and 4 on a case of displaying in $2^{(a+b)}$ gray scales using an (a+b)-bit digital data signal (a and b are each a natural number equal to or larger than 2).

FIG. 3 shows the structure of a pixel portion 100 of a light emitting device that operates in accordance with a driving method of the present invention. The pixel portion is composed of (x x y) (x and y are each a natural number equal to or larger than 1) pixels arranged to form a matrix pattern. Gate signals are input to gate signal lines ($G_1$ to $G_y$), which are each connected to a gate electrode of a switching TFT 101 of each pixel. The switching TFT 101 of each pixel has a source region and a drain region one of which is connected to one of source signal lines ($S_1$ to $S_x$) (also called data signal lines) to which video data signals are input and the other of which is connected to a gate electrode of a driving TFT 104 of each pixel. The driving TFT 104 of each pixel has a source region and a drain region one of which is connected to a power supply line 110 and the other of which is connected to an EL element 106. The power supply line 110 is kept at a certain electric potential and this electric potential is denoted by $V_D$.

A capacitor 108 may be provided between the gate electrode of the driving TFT 104 and the power supply line 110 to serve as a storage capacitor for holding the gate-source voltage of the driving TFT 104.

A video data signal is a signal obtained by converting an (a+b)-bit digital data signal in preparation for digital time division gray scale display and analog gray scale display. The converted signal contains image information constituted of electric potentials $Ve_1$, $Ve_2$, . . . , and $Ve_{2-b}$.

The EL element 106 is composed of an anode, a cathode, and an EL layer that is placed between the anode and the cathode. When the anode is connected to the source region or drain region of the driving TFT 104, the cathode is connected to an opposite electrode 109. On the other hand, when the cathode is connected to the source region or drain region of the driving TFT 104, the opposite electrode 109 is connected to the anode.

Though not shown in FIG. 3, the opposite electrode 109 of each pixel is connected so as to have the same electric potential, i.e. stationary electric potential, which is denoted by $V_C$.

FIG. 4 is a timing chart for carrying out the present invention. One frame period (F) is given one sub-frame period from each of a types of sub-frame periods ($SF_1$ to $SF_a$) that are different in length from one another. A period during which all of the pixels in the pixel portion are used to display one image is called one frame period (F).

In a usual light emitting device, 60 or more frame periods are provided in one second to display 60 or more images per second. If the number of images displayed per second is less than 60, flickering of images is recognizable to the eye.

Periods constituting one frame period are called sub-frame periods (SF).

A sub-frame period has an address period (Ta) and a sustain period (Ts). An address period is a time period required to input digital data signals to pixels in one sub-frame period. A sustain period (also called a lighting period) is a time period in which EL elements emit light.

The sub-frame periods $SF_1$ to $SF_a$ have address periods $Ta_1$ to $Ta_a$, respectively. The address periods $Ta_1$ to $Ta_a$ all have the same length. The sub-frame periods $SF_1$ to $SF_a$ have sustain periods $Ts_1$ to $TS_a$, respectively. The lengths of the sustain periods $Ts_1$ to $Ts_a$ are set such that the sustain period $Ts_1$ is the longest and the sustain period $Ts_a$ is the shortest, and satisfy the following ratio:

$$Ts_1:Ts_2: \ldots :Ts_a=2^{(a-1)}:2^{(a-2)}: \ldots :2^0$$

By setting the lengths of the sustain periods as described above, $2^a$ gray scales are obtained when the light emission luminance of an EL element of each sustain period is the same.

Although the ratio of sustain periods is the ratio of power of 2 in this embodiment mode, gray scale display is possible also when the lengths of the sustain periods are not set in accordance with the ratio of power of 2. By giving different lengths to the sustain periods of the respective sub-frame periods, $2^a$ gray scales are obtained.

In an address period (Ta), a period in which a gate signal line on one row is selected is called one line period (L). Since the light emitting device of FIG. 3 has y gate signal lines, one address period has y line periods ($L_1$ to $L_y$).

The electric potential $V_C$ of the opposite electrode of the EL element 106 in the address period $Ta_1$ of the sub-frame period $SF_1$ is kept at the same level as the electric potential $V_D$ of the power supply line 110. In this embodiment mode, the electric potential $V_C$ of the opposite electrode in an address period is called an OFF stationary electric potential. The OFF stationary electric potential is set to a level that does not cause the EL element 106 to emit light.

In Line Period 1 ($L_1$), a gate signal is input to the gate signal line $G_1$ to turn every switching TFT 101 that is connected to the gate signal line $G_1$ ON.

While every switching TFT 101 connected to the gate signal line $G_1$ is turned ON, video data signals are input to all the source signal lines ($S_1$ to $S_x$) at once. The electric potential of each source signal line is one of electric potentials $Ve_1$, $Ve_2$, . . . , and $Ve_{2-b}$.

The video data signals input to the source signal lines ($S_1$ to $S_x$) are input to the gate electrode of the driving TFT 104 through each switching TFT 101 that has been turned ON. The video data signals are also input to the capacitor 108 of every pixel that is connected to the gate signal line $G_1$ and electric charges of the signals are held in the capacitor.

In Line Period 2 ($L_2$), a gate signal is input to the gate signal line $G_2$ to turn every switching TFT 101 that is connected to the gate signal line $G_2$ ON. While every switching TFT 101 connected to the gate signal line $G_2$ is turned ON, video data signals are input to all the source signal lines ($S_1$ to $S_x$) at once. The video data signals input to the source signal lines ($S_1$ to $S_x$) are input to the gate electrode of the driving TFT 104 through each switching TFT 101 that has been turned ON. The video data signals are also input to the capacitor 108 of every pixel that is connected to the gate signal line $G_2$ and electric charges of the signals are held in the capacitor.

The operations described above are repeated in order until inputting of gate signals to the gate signal lines ($G_1$ to $G_y$) is completed to finish all line periods ($L_1$ to $L_y$). When all of the line periods ($L_1$ to $L_y$) are finished, all the pixels have now received video data signals. A period necessary to complete inputting video data signals to all pixels is an address period.

As the address period $Ta_1$ is ended, the sustain period $Ts_1$ is started. With the start of the sustain period, the electric potential $V_C$ of the opposite electrode is changed from the OFF stationary electric potential to an ON stationary electric potential. In this embodiment mode, the stationary electric potential in a sustain period is called an ON stationary electric potential. The difference between the ON stationary electric potential and the power supply electric potential is large enough to cause an EL element to emit light.

In the sustain period $Ts_1$, every switching TFT 101 is turned OFF. Then the video data signals that have been held in the capacitor 108 are input to the gate electrode of the driving TFT 104.

One of electric potentials $Ve_1$, $Ve_2$, . . . , and $Ve_{2-b}$ is applied to the gate electrode of the driving TFT 104. Currents flowing between the source and drain of the driving TFT 104 when the electric potentials $Ve_1$, $Ve_2$, . . . , and $Ve_{2-b}$ are applied are denoted by $Ie_1$, $Ie_2$, . . . , and $Ie_{2-b}$, respectively. When the current $Ie_1$ flows into the EL element 106, the device emits the brightest light. The EL element 106 emits the darkest light when it receives the current $Ie_2\hat{}_b$. The luminance of the EL element 106 upon receiving the current $Ie_1$, $Ie_2$, . . . , and $Ie_2\hat{}_b$ is denoted by $C_1$, $C_2$, and $C_2\hat{}_b$, respectively. The ratio of $C_1$, $C_2$, . . . , and $C_2\hat{}_b$ is set as follows:

$$C_1:C_2: \ldots :C_{2-b}=2^{(2-b)}: \ldots :2^2:2^1$$

By setting the luminance as described above, $2^b$ gray scales are obtained.

However, gray scale display is possible also when the ratio of the luminance obtained when a current flows into an EL element is not set in accordance with the ratio of power of 2.

Alternatively, the luminance in this embodiment may be set such that the EL element 106 does not emit light when the video data signal has the electric potential $Ve_2\hat{}_b$, namely, $C_1=0$.

As the sustain period $Ts_1$ is ended, the address period $Ta_2$ of the next sub-frame period $SF_2$ is started and video data signals are input to all the pixels similar to the address period $Ta_1$. When inputting of the signals to the pixels is finished, the sustain period $Ts_2$ is started.

Subsequently, the same operation is repeated for the remaining (a−2) sub-frame periods and the sustain periods $Ts_3$, $Ts_4$, . . . , and $Ts_a$ are set in order. In the respective sub-frame periods, given pixels emit light.

As the a sub-frame periods pass, one frame period is ended. With the above driving method, $2^a$ different lengths of sustain periods are combined with $2^b$ levels of EL element luminance to obtain $2^{(a+b)}$ gray scales.

The description given in this embodiment mode deals with the case in which the sub-frame periods $SF_1$ to $SF_a$ are placed in the order stated as shown in FIG. 4. However, the order of sub-frame periods is not limited thereto and the sub-frame periods in one frame period may appear in random order.

In the above-described structure of this embodiment mode, the electric potential $V_D$ of the power supply line 110 is kept constant whereas the electric potential $V_C$ of the opposite electrode 109 is changed in an address period and a sustain period. However, the embodiment mode is not limited to this structure. A reverse structure, in which the electric potential $V_C$ of the opposite electrode 109 is kept constant whereas the electric potential $V_D$ of the power supply line 110 is changed in an address period and a sustain period, may be employed. Alternatively, the electric potential $V_D$ of the power supply line 110 and the electric potential $V_C$ of the opposite electrode 109 may both be changed in an address period and a sustain period.

In order to obtain $2^{(a+b)}$ gray scales by the driving method of the present invention, one condition is indispensable; $2^b$ levels of currents flowing into EL elements have to be set such that the luminance for the x-th gray scale is smaller than the luminance for the (x+1)-th gray scale when the first gray scale is the darkest and the $2^{(a+b)}$-th gray scale is the brightest (x is a natural number equal to or larger than 1 and equal to or smaller than $2^{(m+n)}-1$).

An example is given in which, of 4 bits of video data input from the external to the pixel portion, 2 bits of the data are input as information on time division gray scales (a=2) whereas the other 2 bits of the data are input as information on analog gray scales (b=2). Table 1 shows gray scale levels to be obtained, the relation between the luminance and the gray scale, and values of currents flowing into an EL element in sustain periods associated with the respective bits.

| luminance | gray scale | first bit Ts1 | second bit Ts2 |
|---|---|---|---|
| small | 1 | Ie4 | Ie4 |
| \| | 2 | Ie4 | Ie3 |
| \| | 3 | Ie4 | Ie2 |
| \| | 4 | Ie4 | Ie1 |
| \| | 5 | Ie3 | Ie4 |
| \| | 6 | Ie3 | Ie3 |
| \| | 7 | Ie3 | Ie2 |
| \| | 8 | Ie3 | Ie1 |
| \| | 9 | Ie2 | Ie4 |
| \| | 10 | Ie2 | Ie3 |
| \| | 11 | Ie2 | Ie2 |
| \| | 12 | Ie2 | Ie1 |
| \| | 13 | Ie1 | Ie4 |
| \| | 14 | Ie1 | Ie3 |
| ↓ | 15 | Ie1 | Ie2 |
| big | 16 | Ie1 | Ie1 |

For example, assume that, in a pixel where the gate electrode of the switching TFT 101 is connected to the gate signal line $G_2$ and its source region or drain region is connected to the signal line $S_2$, an EL element of the pixel emits light at the 7-th gray scale in frame period. In this case, while a gate signal is input to the gate signal line $G_2$ in the address period $Ta_1$, the electric potential of the source signal line $S_2$ is set to $Ve_3$ and the electric potential of the source signal line $S_2$ is set to $Ve_2$ while a gate signal is input to the gate signal line $G_2$ in the address period $Ta_2$. As a result, the current $Ie_3$ flows into the EL element in the sustain period $Ts_1$ and the current $Ie_2$ flows into the EL element in the sustain period $Ts_2$. Therefore the EL element emits light at the 7-th gray scale.

To obtain the gray scales shown in Table 1, the currents $Ie_1$, $Ie_2$, $Ie_3$, and $Ie_4$ flowing into the EL element 106 have to be set such that the first gray scale is the darkest and the luminance is increased as the gray scale number counts up until the brightest luminance is reached at the 16-th gray scale.

When displaying an image in $2^{(a+b)}$ gray scales using an (a+b)-bit digital data signal, the structure of the present invention makes it possible to reduce the number of sub-frames by b frames than when digital time division gray scale display is employed. If an address period in the structure of the present invention is equal in length with an address period in the digital time division method, the duty ratio in the structure of the present invention is larger because of the reduction in sub-frame number. Accordingly, the present invention can provide a light emitting device which emits brighter light and which presents higher image quality than the digital time division method. If a circuit for sending signals to pixels is operated by the structure of the present invention and by the digital time division method using the same duty ratio, the circuit can operate at a slower speed in the structure of the present invention than in the digital time division method. Therefore the present invention can provide a light emitting device of less power consumption.

In the example shown in this embodiment mode, one frame period is given one sub-frame period from each of a types of sub-frame periods of different lengths and $2^a$ gray scales are obtained using an a-bit digital video signal. However, the present invention is not limited thereto. For instance, some of the a types of sub-frame periods of different lengths may provide more than one sub-frame periods so that one frame period has sub-frame periods that are equal in length. As an example, in one frame period, two sub-frame periods $SF_1$ may be provided while other sub-frame periods $SF_2$, to $SF_a$. are provided by one. Also, as mentioned above, the order of sub-frame periods in one frame period may not match the order of period length (longest comes first) as in FIG. 4 but may be random.

Embodiment Mode 2

In Embodiment Mode 1, one frame period (F) is given one sub-frame period from each of a types of sub-frame periods of different lengths and EL elements emit light at $2^b$ levels of luminance in sustain periods of the respective sub-frame periods to obtain $2^{(a+b)}$ gray scales. However, gray scales that can be obtained are not limited to power of 2. It is possible to give one frame period (F) one sub-frame period from each of m (m is a natural number equal to or larger than 2) types of sub-frame periods $SF_1$ to $SF_m$ and to make EL elements emit light at n (n is a natural number equal to or larger than 2) levels of luminance in sustain periods of the respective sub-frame periods to obtain $n^m$ gray scales. Then, n levels of currents flowing into EL elements have to be set such that the luminance for the x-th (x is a natural number equal to or larger than 1 and equal to or smaller than $n^m-1$) gray scale is smaller than the luminance for the (x+1)-th gray scale when the first gray scale is the darkest and the $n^m$-th gray scale is the brightest.

In this embodiment mode also, sub-frame periods in one frame period may be in random order instead of the order of period length (longest comes first) as in FIG. 4.

In the example shown in this embodiment mode, one frame period is given one sub-frame period from each of m types of sub-frame periods of different lengths. However, the present invention is not limited thereto. For instance, of the m types of sub-frame periods of different lengths, more than one sub-frame periods may be provided so that one frame period has sub-frame periods that are equal in length. As an example, in one frame period, two sub-frame periods $SF_1$ may be provided while other sub-frame periods $SF_2$, to $SF_m$ are provided by one. In this case also, the order of sub-frame periods in one frame period may not match the order of period length (longest comes first) but may be random.

Embodiment Mode 3

Figure 5:
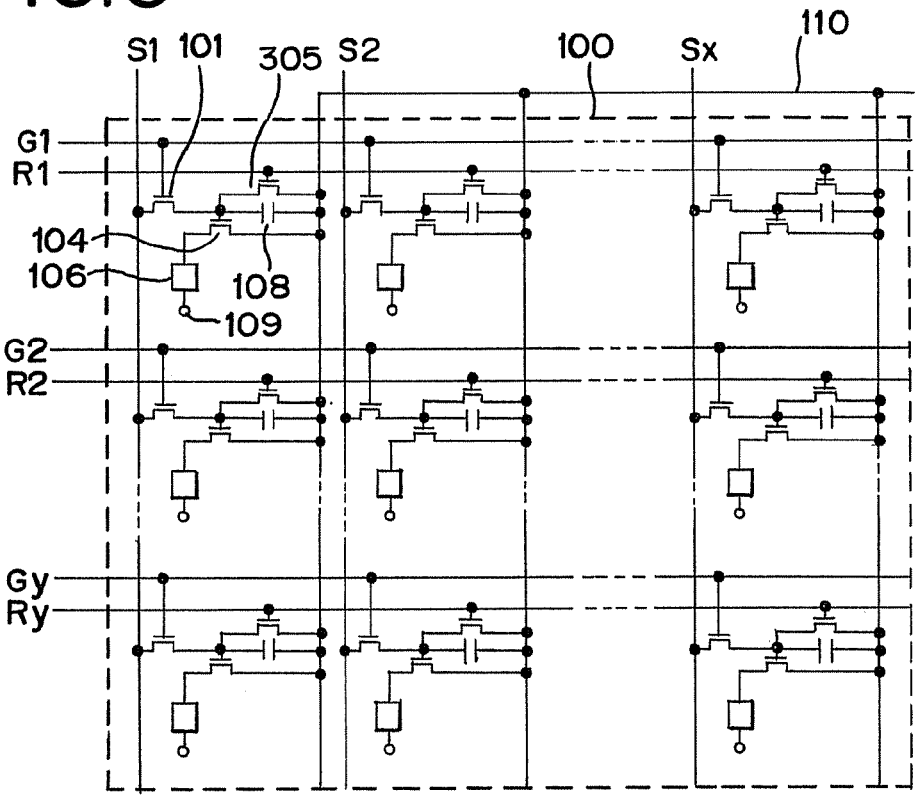
FIG. 5 is a diagram showing a circuit example of a pixel portion in a light emitting device of the present invention.

The pixel portion in Embodiment Modes 1 and 2 is structured as shown in FIG. 3. However, the pixel structure of a light emitting device of the present invention is not limited to the one shown in FIG. 3. For instance, the current supply line 109, which is shared by all the pixels in FIG. 3, may be provided for each source signal line independent of one another. The present invention may also employ a pixel structure in FIG. 5 which is obtained by adding an erasing TFT 305 to the pixel structure of FIG. 3, so that electric charges accumulated in storage capacitor 108 are released.

Embodiment Mode 4

Usually, an EL element emits light when an electric potential higher than the electric potential of its cathode is applied to its anode to cause a current to flow from the anode toward the cathode. Alternatively, when an electric potential higher than the electric potential of the anode is applied to the cathode, no current flows in the EL element but the lifetime of the EL element is prolonged. A voltage that causes a current to flow in an EL element as in the normal case is called a forward bias voltage and a voltage reverse to the forward bias voltage is called reverse bias voltage.

In Embodiment Modes 1, 2, and 3, a period in which no EL elements emit light may be provided in a frame period in order to apply a reverse bias voltage to the EL elements in all of the pixels in this period. If the pixel structure employed is one that can use the technique disclosed in Japanese Laid-Open Publication No. 2001-109432 A, a reverse bias voltage may be applied to EL elements in an address period in which the EL elements do not emit light.

Embodiments of the present invention will be described below.

Embodiment 1

A light emitting device that operates in accordance with a driving method of the present invention will be described using a circuit structure example shown in FIGS. 6A and 6B.

Figure 6A:
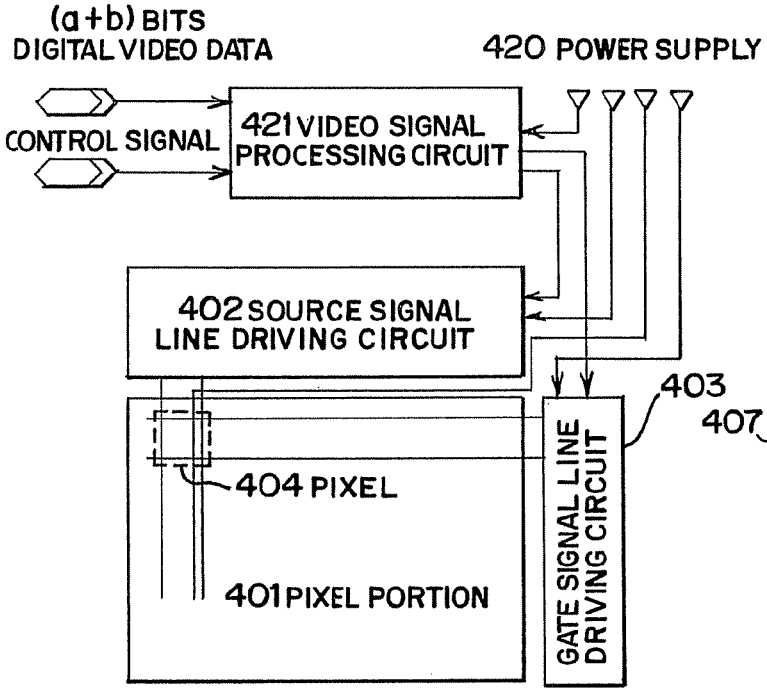
FIGS. 6A and 6B are diagrams showing an example of the circuit structure of a light emitting device of the present invention.

A light emitting device in FIG. 6A has a pixel portion 401, a source signal line driving circuit 402, and a gate signal line driving circuit 403. The driving circuits are arranged in the periphery of the pixel portion 401. TFTs formed on a substrate constitute the pixel portion and the driving circuits. Although the light emitting device in the example shown in FIG. 6A has one source signal line driving circuit and one gate signal line driving circuit, the number of source signal line driving circuits and the number of gate signal line driving circuits may be arbitrary.

An (a+b)-bit (a is a natural number equal to or larger than 2, b is a natural number equal to or larger than 2) video data signal and a control signal are input from the external and converted in a video signal processing circuit 421. As a result of conversion, a control signal and an analog data signal are generated to be input to the source signal line driving circuit 402 and the gate signal line driving circuit 403.

The video signal processing circuit 421 has means for setting sub-frame periods in accordance with gray scales of a bits in one frame period, means for outputting gray scales of b bits as analog data signals, and means for outputting control signals that are used to operate the source signal line driving circuit 402 and the gate signal line driving circuit 403. The sub-frame periods are each divided into an address period and a sustain period. Sustain periods are set in accordance with gray scales of a bits.

The video signal processing circuit 421 may be placed outside a light emitting device operated by a driving method of the present invention, so that a data signal generated by the circuit is input to the light emitting device. In this case, a light emitting device operated by a driving method of the present invention and a video signal processing circuit make separate parts of electronic equipment that has as its display unit the light emitting device operated by a driving method of the present invention.

Alternatively, the video signal processing circuit 421 may be mounted in the form of an IC chip to a light emitting device operated by a driving method of the present invention, so that a digital data signal generated by the IC chip is input to the light emitting device. In this case, a light emitting device which is operated by a driving method of the present invention and to which an IC chip including a video signal processing circuit is mounted makes a part of electronic equipment that has as its display unit the light emitting device operated by a driving method of the present invention.

Another option is to build the video signal processing circuit 421 from a TFT on the same substrate where the pixel portion 401, the source signal line driving circuit 402, and the gate signal line driving circuit 403 are formed. In this case, all processing can be done on the substrate by inputting a video signal including image information, a control signal, and a power supply voltage to the light emitting device. The video signal processing circuit of this case may be composed of a TFT whose active layer is formed from a poly-silicon film. When this light emitting device operated by a driving method of the present invention is used as a display unit of electronic equipment, the electronic equipment can be reduced in size because the light emitting device has a built-in video signal processing circuit.

Figure 7:
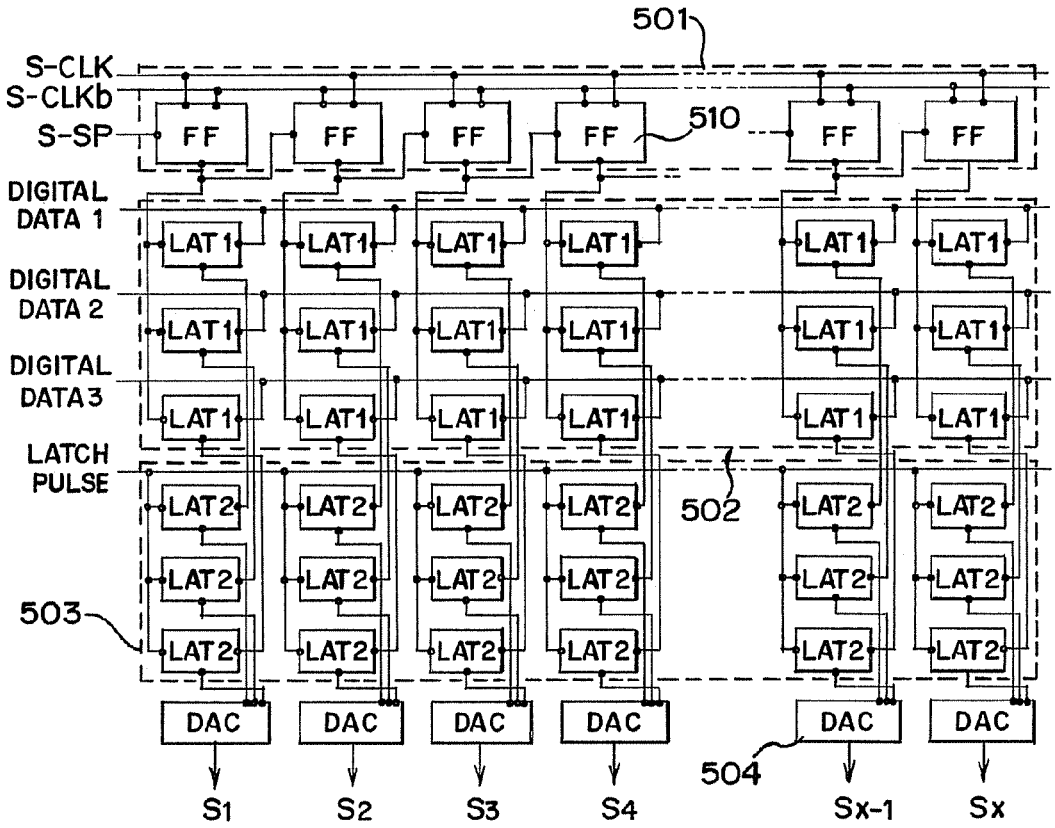
FIG. 7 is a diagram showing an example of the source side driving circuit of FIG. 6A.

FIG. 7 is a schematic diagram of the source signal line driving circuit used in this embodiment. The circuit has a shift register 501, a first latch circuit 502, a second latch circuit 503, a D/A converter circuit 504, and others. The shift register is composed of plural stages of flip-flops 510. Shown in FIG. 7 is a circuit structure of when b=3, and a digital video signal is input for each bit. Here, a 3-bit digital video signal is input from 3 signal lines. Signals input from the external are clock signals (S-CLK), inverted clock signals (S-CLKb), start pulses (S-SP), digital video signals (Digital Data 1 to 3), and latch pulses.

First, the shift register 501 outputs sampling pulses sequentially in timing with clock signals, inverted clock signals, and start pulses. Thereafter, the sampling pulses are input to the first latch circuit 502, where a digital video signal for each bit is input and held in response to input of the sampling pulses. This operation is conducted in order starting from the first column.

When holding of a digital video signal in the last stage of the first latch circuit is completed, latch pulses are input and, in response, the digital video signals held in the first latch circuit 502 are transferred to the second latch circuit 503 all at once.

Then, the digital video signals for the respective bits are input to the D/A converter circuit 504 and converted into analog video signals, which are output to their respective source signal lines ($S_1$, $S_2$, . . . , $S_x$).

Figure 8:
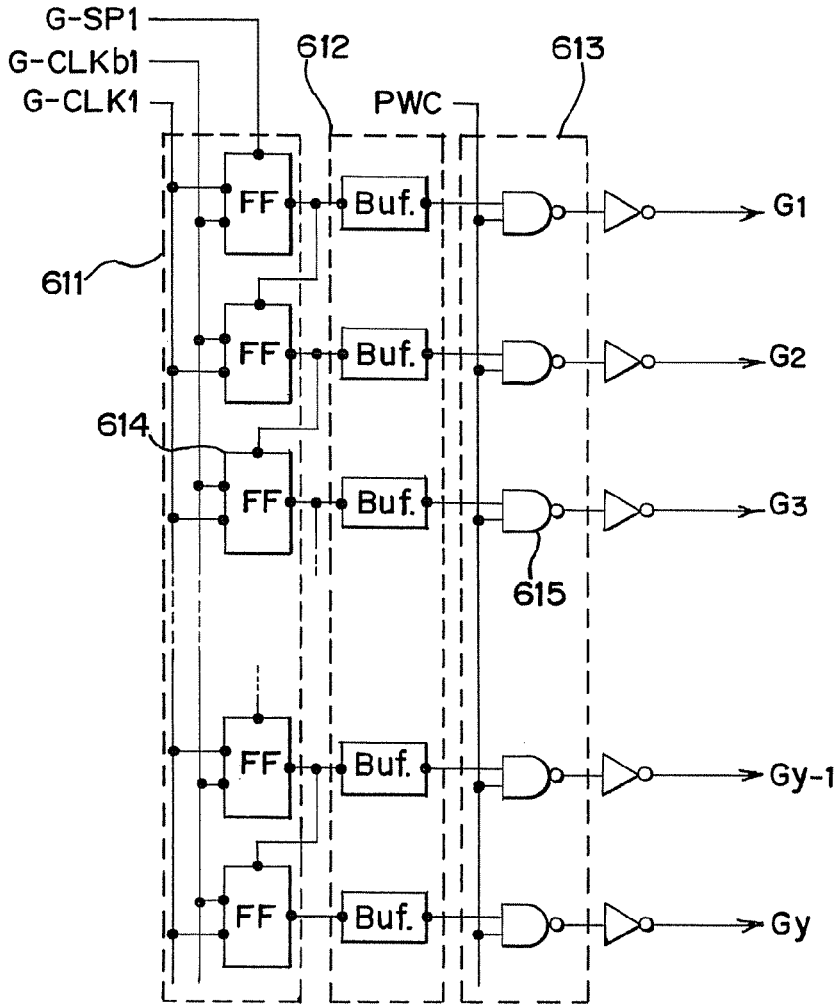
FIG. 8 is a diagram showing an example of the gate side driving circuit of FIG. 6A.

FIG. 8 is a schematic diagram of the gate signal line driving circuit used in this embodiment. The circuit has a shift register 611, a buffer 612, a pulse width control circuit 613, and others. The shift register is composed of plural stages of flip-flops 614. The pulse width control circuit is composed of plural NANDs 615 or the like. Signals input from the external are clock signals (G-CLK), inverted clock signals (G-CLKb), start pulses (G-SP), and pulse width control signals (PWC).

First, the shift register 611 outputs pulses sequentially in timing with clock signals, inverted clock signals, and start pulses. The output pulses are amplified by the buffer 612 or the like and then the pulse width thereof is adjusted by the pulse width control circuit 613 such that the sequentially output pulses do not overlap one another. Thereafter, the pulses pass through the buffer or the like (if necessary) and are output to their respective gate signal lines ($G_1$, $G_2$, . . . , $G_y$) to select the gate signal lines in order. The gate signal line on the first row is selected first and the subsequent lines are selected in order until the last gate signal line $G_y$ is selected. When selection of the last gate signal line $G_y$ is finished, a vertical retrace period is started and then pulses are again output from the shift register 611 to begin selecting the gate signal lines.

Pixels 404 are arranged to form a matrix pattern in the pixel portion 401 of FIG. 6A. An enlarged view of one of the pixels 404 is shown in FIG. 6B. In FIG. 6B, denoted by 405 is a switching TFT. A gate electrode of the switching TFT 405 is connected to a gate signal line 406 to which a gate signal is input. The switching TFT 405 has a source region and a drain region one of which is connected to a source signal line 407 to which a digital data signal is input and the other of which is connected to a gate electrode of a driving TFT 408.

The driving TFT 408 has a source region and a drain region one of which is connected to a power supply line 411 and the other of which is connected to an EL element 410. A capacitor 413 may be provided between a gate electrode of the driving TFT 408 and the power supply line, so that the gate-source voltage of the driving TFT 408 is held while the switching TFT 405 is not selected (when 405 is OFF).

The EL element 410 is composed of an anode, a cathode, and an EL layer that is placed between the anode and the cathode. When the anode is connected to the source region or drain region of the driving TFT 408, the cathode is connected to an opposite electrode 412. On the other hand, when the cathode is connected to the source region or drain region of the driving TFT 408, the opposite electrode 412 is connected to the anode.

The power supply line 411 is kept at a certain electric potential.

A resistor may be provided between the drain region or source region of the driving TFT 408 and the EL element 410. With the resistor, the amount of current supplied from the driving TFT 408 to the EL element 410 can be controlled and influence of fluctuation in characteristic of the driving TFT 408 can be removed. The resistor can take any structure since it only has to have a sufficiently larger resistance value than the ON resistance of the driving TFT 408. ON resistance is obtained by dividing a drain voltage of a TFT by a drain current flowing when the TFT is ON. The resistance value of the resistor is 1 kΩ to 50 MΩ (desirably 10 kΩ to 10 MΩ, more desirably 50 kΩ to 1 MΩ). The resistor is easily formed from a semiconductor layer having a high resistance value.

Figure 9A:
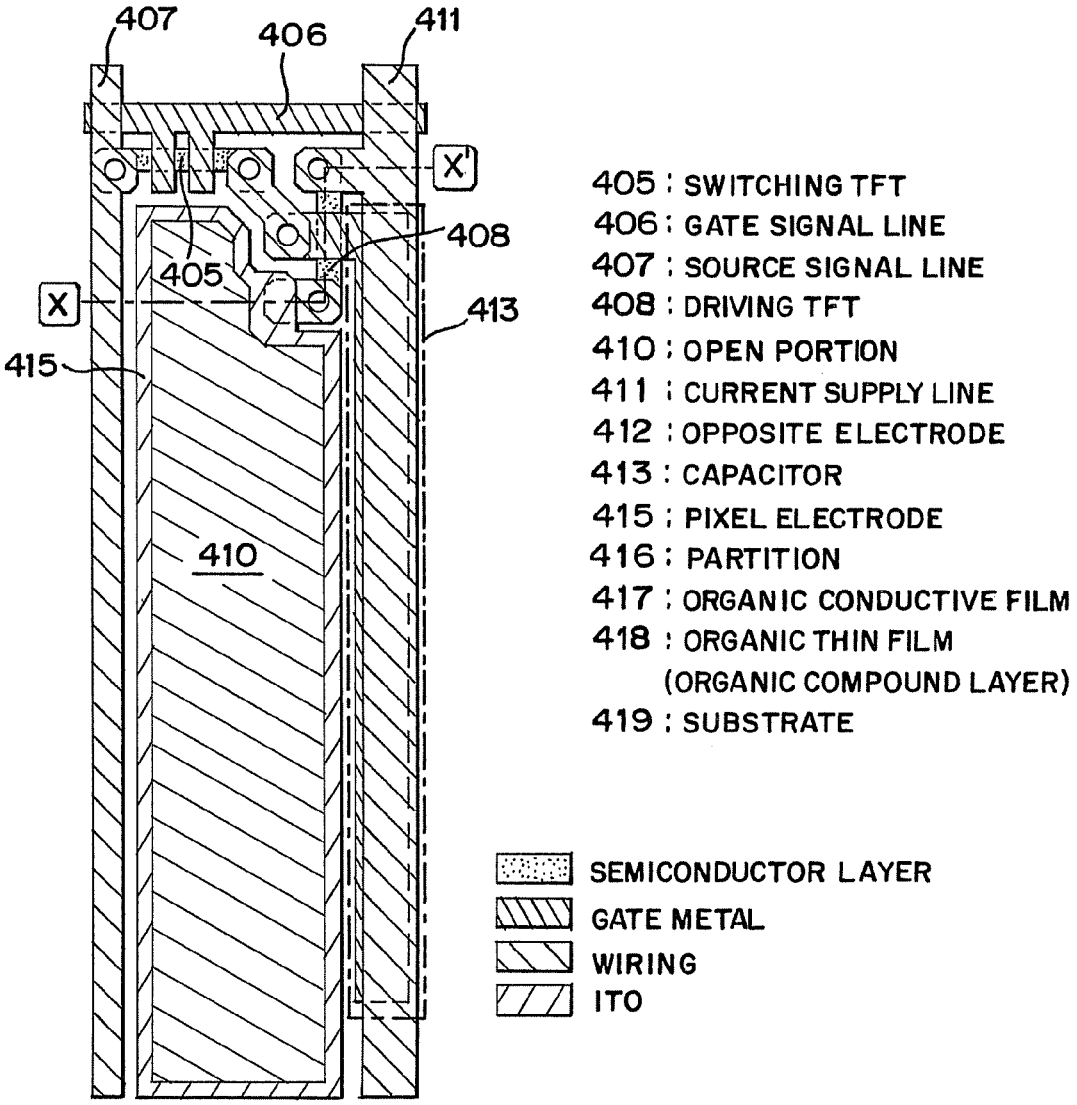
FIGS. 9A and 9B are diagrams showing a layout example of the pixel portion of FIGS. 6A and 6B.
Figure 9B:
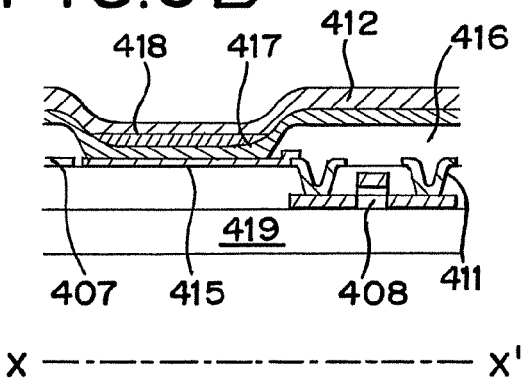

FIG. 9A shows an device layout example for a pixel manufactured to have the structure of FIG. 7. FIG. 9B is a sectional view taken along the line X-X' in FIG. 9A.

In FIG. 9B, denoted by 419 is a substrate having an insulating surface. The driving TFT 408 and other devices are formed on the substrate 419. Source and drain electrodes are formed from wire materials and connected to impurity regions that serve as source and drain regions of the driving TFT 408. The source electrode or the drain electrode overlaps and connects with a pixel electrode 415. An organic conductive film 417 is formed on the pixel electrode 415. An organic thin film (organic compound layer) 418 is formed on the conductive film. Formed on the organic thin film (organic compound layer) 418 is the opposite electrode 412. The opposite electrode 412 fits snugly to the organic thin film (organic compound layer) 418 so that it is connected to and shared by all the pixels.

Light emitted from the organic thin film (organic compound layer) 418 is transmitted through the pixel electrode 415 or the opposite electrode 412 before it reaches the outside. If the light is emitted toward the pixel electrode side in FIG. 9B, namely, toward the side where the TFTs and others are formed, it is called downward emission. If the light is emitted toward the opposite electrode side, it is called upward emission.

In the case of downward emission, the pixel electrode 415 is formed from a transparent conductive film. In the case of upward emission, the opposite electrode 412 is formed from a transparent conductive film.

In a light emitting device for color display, EL elements emitting R color light, EL elements emitting G color light, and EL elements emitting B color light are separately formed. Alternatively, EL elements that emit light of a single color are formed from a snugly-fit film and color filters are used to obtain R color light emission, G color light emission, and B color light emission.

Figure 6B:
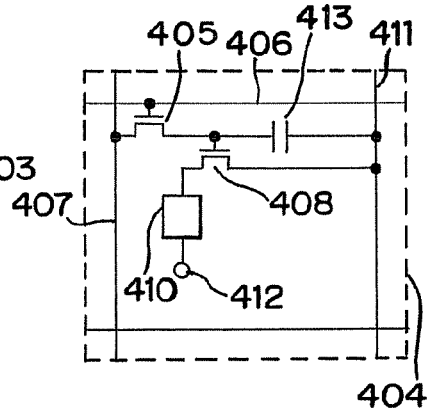

The structures of FIGS. 6A and 6B are merely one of preferred modes of carrying out the present invention and the present invention can be carried out in other light emitting device structures than the ones shown in FIGS. 6A and 6B. The structures shown in this embodiment are given as examples and the pixel layout, the sectional structure, the order of layering electrodes of an EL element are not limited thereto.

Embodiment 2

Figure 10A:
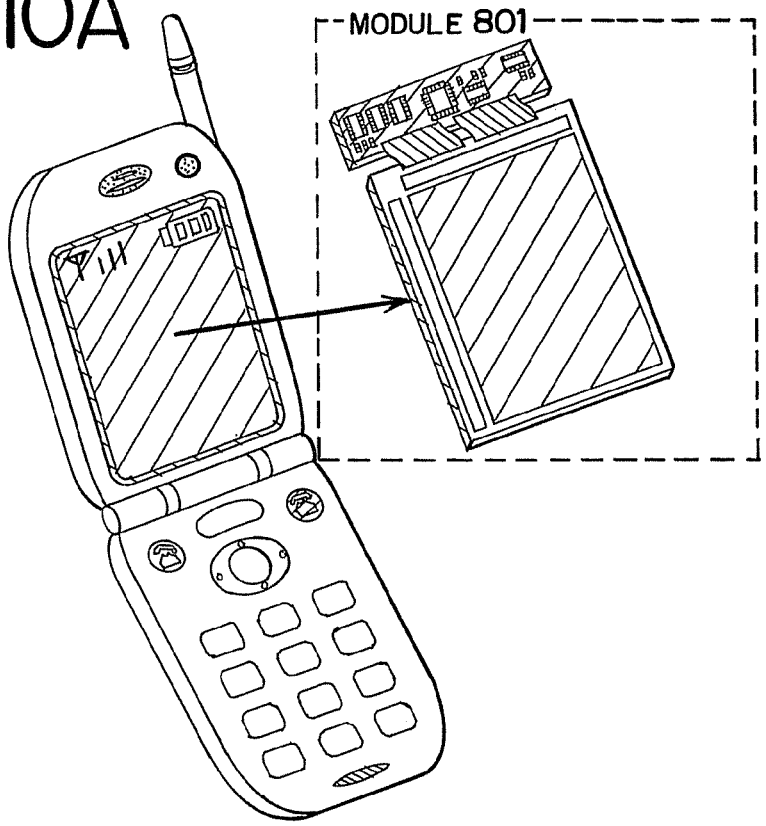
FIGS. 10A and 10B are diagrams showing an example in which a light emitting device and a peripheral circuit are made into a module and used in electronic equipment.

Referring to FIG. 10A, the light emitting devices are built-in as the form of a module 801 when it is incorporated as a display device of an electronic equipment such as cell phone or the like. Here, the module 801 stands for the one in which the light emitting device is connected to a substrate where a signal processing LSI for driving the light emitting device, a memory and the like are mounted.

Figure 10B:
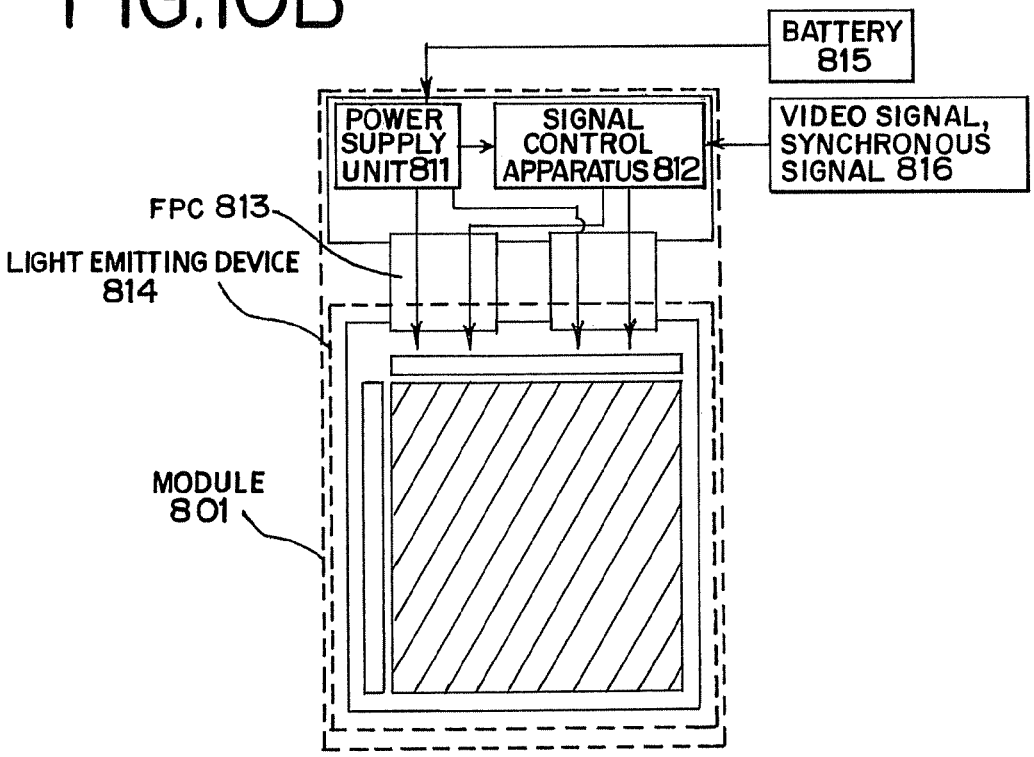

FIG. 10B is a block diagram of the module 801. The module 801 includes a power supply unit 811, a signal control unit 812, an FPC 813 and a light emitting device 814. Being powered by an external battery 815 and the like, the power supply unit 811 forms a plurality of desired voltages and supplies them with the source signal line drive circuit, the gate signal line drive circuit, the EL elements and the like. The signal control unit 812 receives video signals and synchronizing signals 816, converts them into various signals so as to be processed in the light emitting device and forms clock signals and the like for driving the source signal line drive circuit and the gate signal line drive circuit.

The module 801 of this embodiment includes the light emitting device 814, the power supply unit 811 and the signal control unit 812, which are independently formed. They, however, may be formed integrally together on a substrate.

FIG. 11 illustrates, in detail, the constitution of the light emitting device 814 included in the module 801 shown in FIG. 10.

The light emitting device is, on the substrate 901, constituted by a pixel portion 903, a source signal line drive circuit 904, gate signal line drive circuits 905 and 906, an FPC 907 and the like. The opposing substrate 902 may be made of a transparent material such as glass or a metallic material. A gap between the substrate 901 and the opposing substrate 902 is sealed with a filler, and is often filled with a drying agent to prevent the EL elements from being deteriorated with water.

Figure 11A:
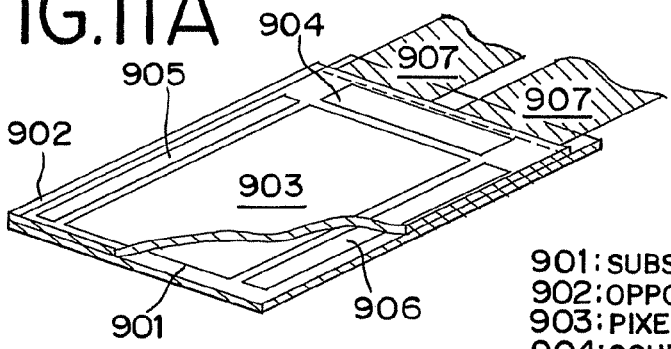
FIGS. 11A and 11B are diagrams showing an outline of a light emitting device.
Figure 11B:
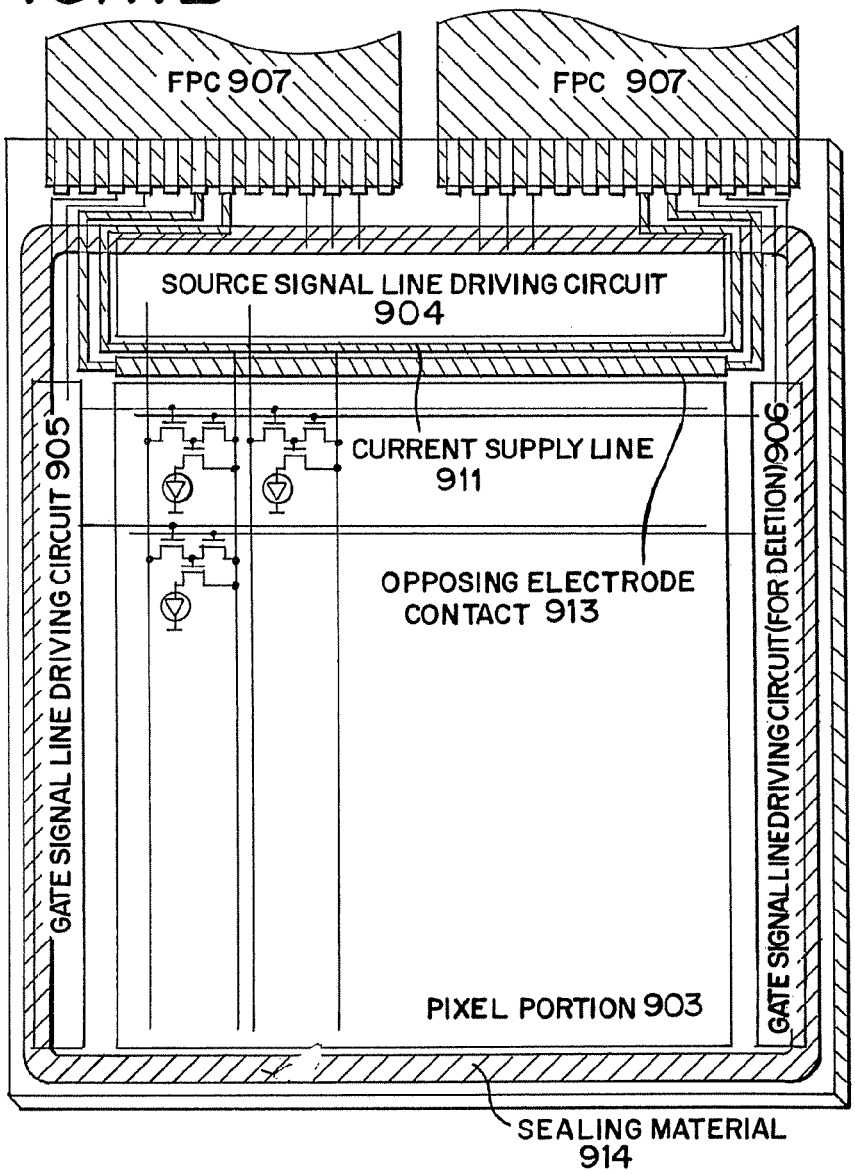

FIG. 11B is a top view. A pixel portion 903 is arranged on the central portion of the substrate. On the peripheries, there are arranged the source signal line drive circuit 904, and the gate signal line drive circuits 905 and 906. On the peripheries of the source signal line drive circuit 904, there are arranged a current supply line 911 and an opposing electrode contact 913 and the like. The opposing electrodes of the EL elements are formed on the whole surface of the pixel portion, and an opposing potential is applied from the opposing electrode contact 913 through the FPC 907. Signals for driving the source signal line drive circuit 904 and the gate signal line drive circuits 905, 906, as well as the power supply, are fed from external units through the FPC 907.

A sealing member 914 for sticking the substrate 901 and the opposing substrate 902 may be so formed as to be partly overlapped with the source signal line drive circuit 904 and on the gate signal line drive circuits 905, 906 as shown in FIG. 11B. Then, the frame of the light emitting device can be narrowed.

Embodiment 3

This embodiment describes results of measuring luminance degradation when an EL element, which employs a high-molecular weight organic compound for an organic compound layer and which has a buffer layer formed from a conductive high-molecular weight compound between an anode and the organic compound layer, receives direct current driving (application of forward bias alone) and alternating current driving (alternate application of forward bias and reverse bias in a certain cycle).

Figure 12A:
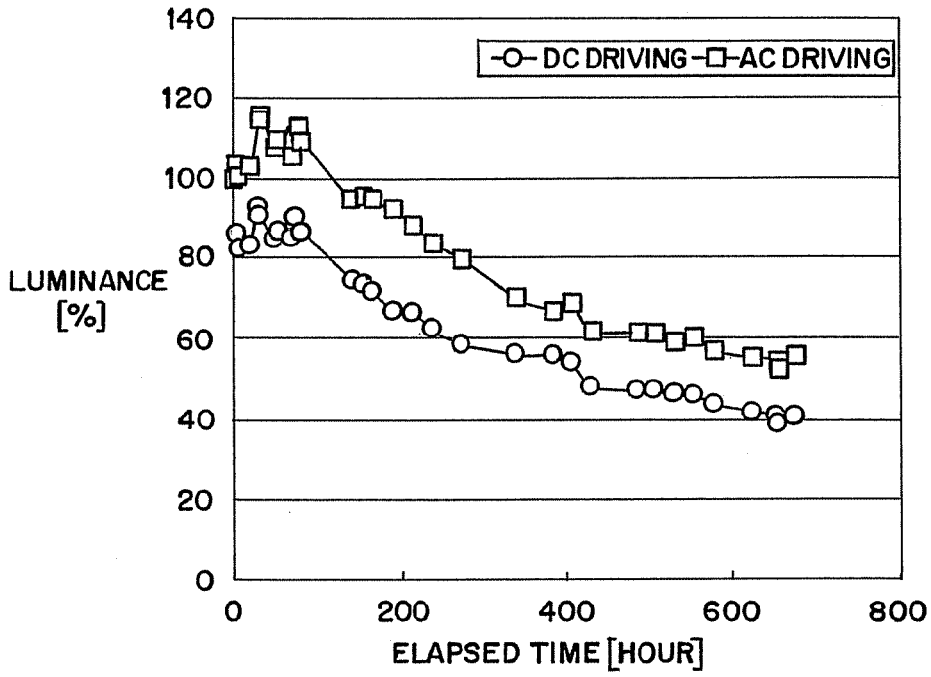
FIGS. 12A to 12D are graphs showing luminance degradation when an EL element receives direct current driving (application of forward bias alone) and alternating current driving (alternate application of forward bias and reverse bias in a certain cycle)
Figure 12B:
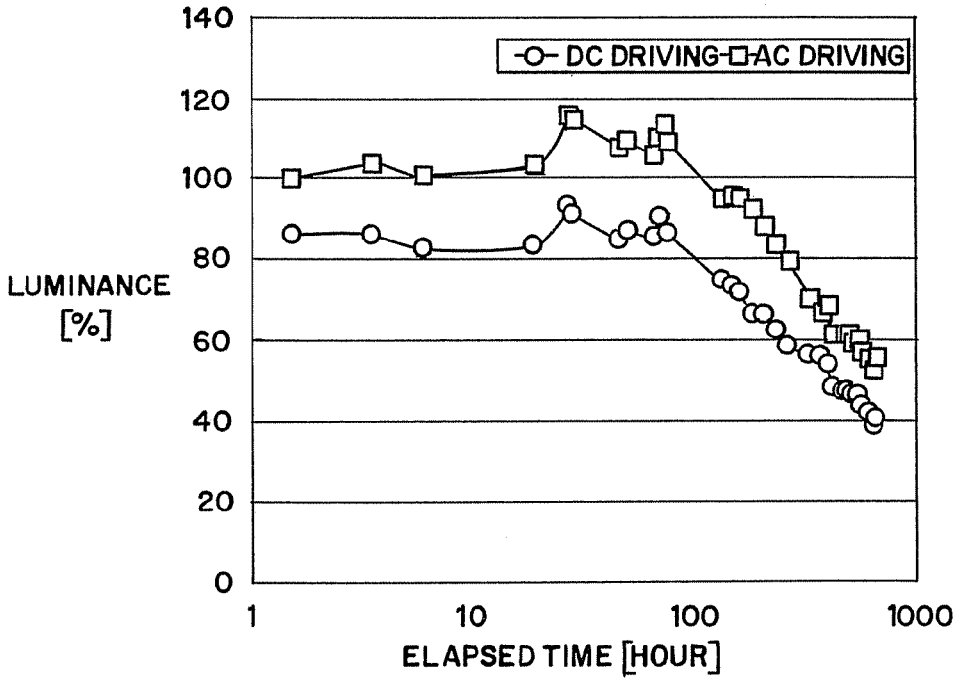

FIGS. 12A and 12B show results of a reliability test performed on the EL element when it is driven by alternating current driving setting the forward bias to 3.7 V, the reverse bias voltage to 1.7 V, the duty ratio to 50%, and the alternating current frequency to 60 Hz. The initial luminance is about 400 cd/cm$^2$. For comparison, FIGS. 12A and 12B also show results of a reliability test when the EL element is driven by direct current driving (forward bias: 3.65 V). The luminance is reduced in half in about 400 hours in the direct current driving whereas more than half he initial luminance is still left after about 700 hours in the alternating current driving.

Figure 12C:
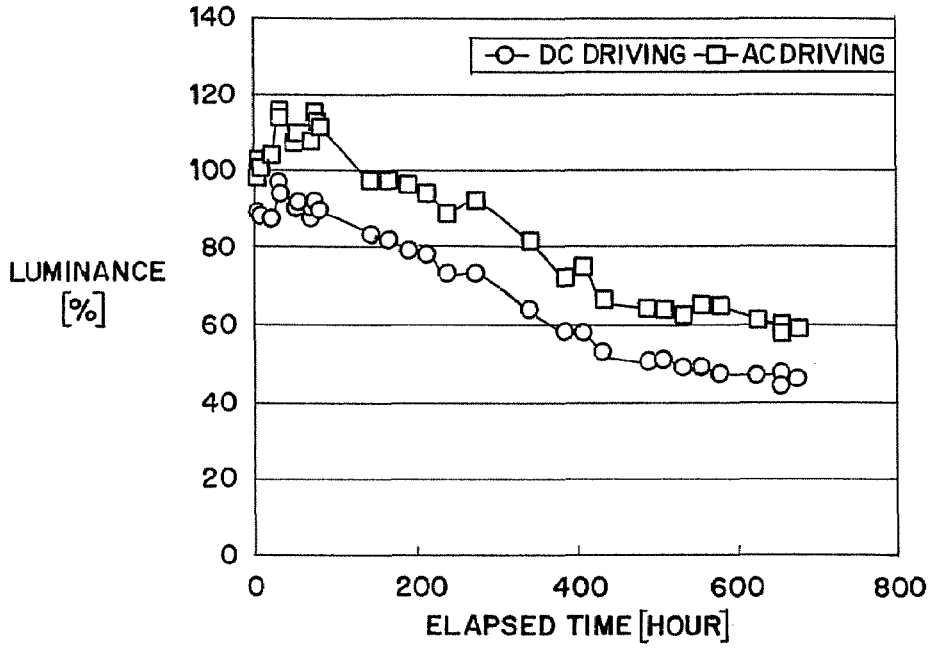
Figure 12D:
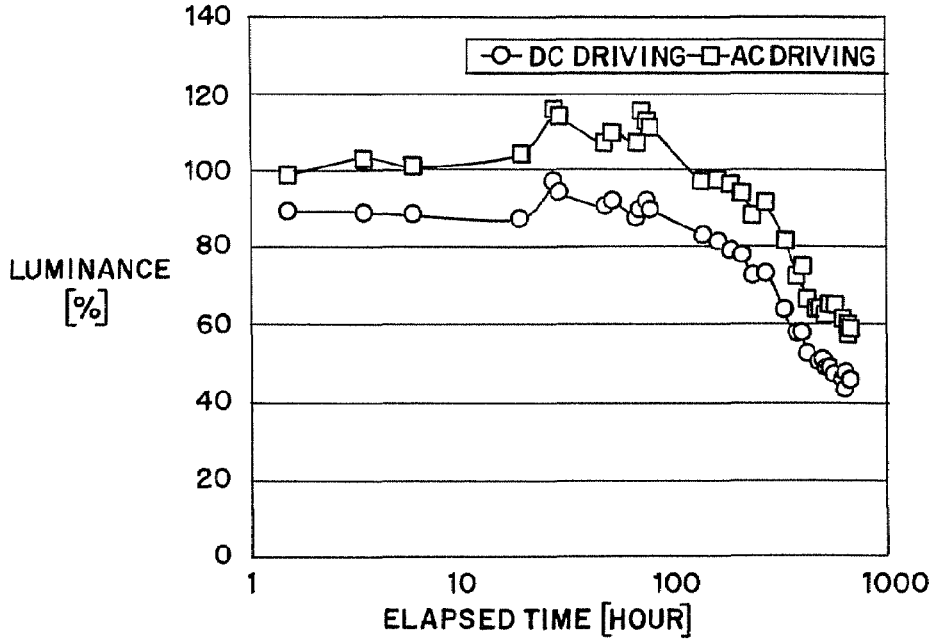

FIGS. 12C and 12D show results of a reliability test performed on the EL element when it is driven by alternating current driving setting the forward bias to 3.8 V, the reverse bias voltage to 1.7 V, the duty ratio to 50%, and the alternating current frequency to 600 Hz. The initial luminance is about 300 cd/cm$^2$. For comparison, FIGS. 12C and 12D also show results of a reliability test when the EL element is driven by direct current driving (forward bias: 3.65 V). The luminance is reduced in half in about 500 hours in the direct current driving whereas approximately 60% of the initial luminance is still left after about 700 hours in the alternating current driving.

Embodiment 4

The light emitting device is of the self-emission type, and thus exhibits more excellent recognizability of the displayed image in a light place and has a wider viewing angle as compared to the liquid crystal display device. Accordingly, the light emitting device can be applied to a display portion in various electronic equipments.

Such electronic equipments using a light emitting device of the present invention include a video camera, a digital camera, a goggles-type display (head mount display), a navigation system, a sound reproduction device (such as a car audio equipment and an audio set), a lap-top computer, a game machine, a portable information terminal (such as a mobile computer, a cell phone, a portable game machine, and an electronic book), an image reproduction device including a recording medium (more specifically, a device which can reproduce a recording medium such as a Digital Versatile Disc (DVD) and so forth, and includes a display for displaying the reproduced image), or the like. In particular, in the case of the portable information terminal, use of the light emitting device is preferable, since the portable information terminal that is likely to be viewed from a tilted direction is often required to have a wide viewing angle. FIGS. 13A to 13E respectively shows various specific examples of such electronic equipments.

Figure 13A:
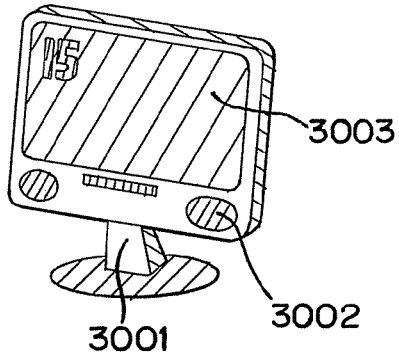
FIGS. 13A to 13E are diagrams showing electronic equipment using a light emitting device of the present invention.

FIG. 13A illustrates an EL display which includes a casing 3001, a support table 3002, a display portion 3003 and the like. The present invention is applicable to the display portion 3003. The light emitting device is of the self-emission-type and therefore requires no backlight. Thus, the display portion thereof can have a thickness thinner than that of the liquid crystal display device. The light emitting device display device is including the entire display device for displaying information, such as a personal computer, a receiver of TV broadcasting and an advertising display.

Figure 13B:
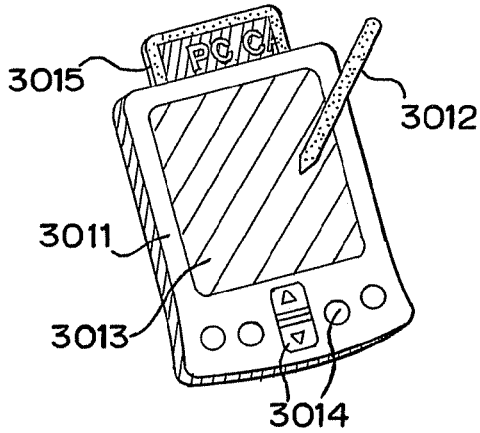

FIG. 13B illustrated a mobile computer which includes a main body 3011, a stylus 3012, a display portion 3013, switches 3014, an external interface 3015 and the like. The light emitting device of the present invention can be used as the display portion 3013.

Figure 13C:
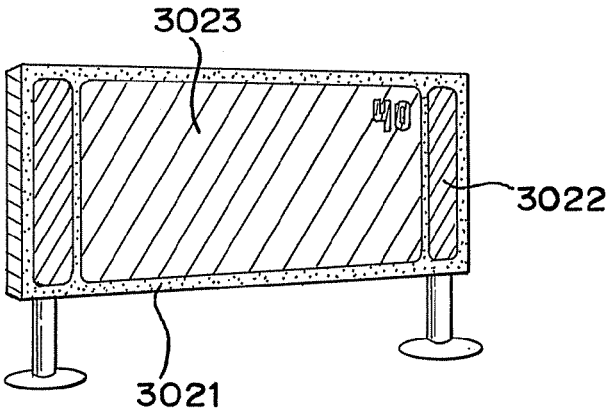

FIG. 13C illustrated a large EL display which includes a casing 3021, a sound output portion 3022, a display portion 3023 as same as the FIG. 11A. The light emitting device of the present invention can be used as the display portion 3023.

Figure 13D:
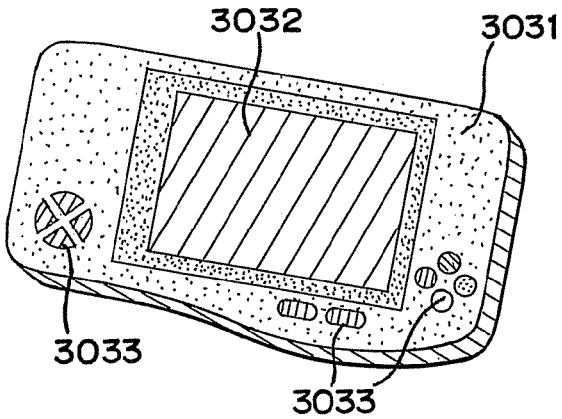

FIG. 13D illustrated a game machine which includes a main body 3031, a display portion 3032, a switches 3033 and the like. The light emitting device of the present invention can be used as the display portion 3032.

Figure 13E:
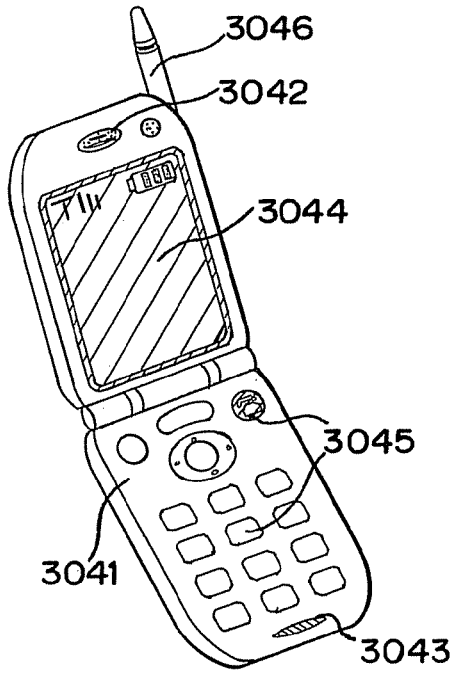

FIG. 13E illustrates a cell phone which includes a main body 3041, a sound output portion 3042, a sound input portion 3043, a display portion 3044, switches 3045 an antenna 3046 and the like. The light emitting device of the present invention can be used as the display portion 3044. Note that the display portion 3044 can reduce power consumption of the cell phone by displaying white-colored characters on a black-colored background.

When the brighter luminance of light emitted from the organic light emitting material becomes available in the future, the light emitting device in accordance with the present invention will be applicable to a front-type or rear-type projector in which light including output image information is enlarged by means of lenses or the like to be projected.

The aforementioned electronic equipments are more likely to be used for display information distributed through a telecommunication path such as Internet, a CATV (cable television system), and in particular likely to display moving picture information. The light emitting device is suitable for displaying moving pictures since the organic light emitting material can exhibit high response speed.

A portion of the light emitting device that is emitting light consumes power, so it is desirable to display information in such a manner that the light emitting portion therein becomes as small as possible. Accordingly, when the light emitting device is applied to a display portion which mainly displays character information, e.g., a display portion of a portable information terminal, and more particular, a cell phone or a sound reproduction device, it is desirable to drive the light emitting device so that the character information is formed by a light emitting portion while a non-emission portion corresponds to the background.

As set forth above, the present invention can be applied variously to a wide range of electronic equipments in all fields. Moreover, the electronic equipments in this example can be implemented by using any structure of the light emitting devices in Examples 1 to 2.

Advantageous Effect

The present invention can reduce fluctuation in amount of current output when there is slight fluctuation in Id-Vg characteristic among TFTs and the same gate-source voltage is applied to the TFTs. Accordingly, the present invention can prevent the Id-Vg characteristic fluctuation from causing a great difference in EL element light emission amount between adjacent pixels when signals of the same voltage are input.

When the gray scale number is the same, the number of sub-frame period is less in a driving method of the present invention than in digital time division gray scale display. Accordingly, the present invention can set the duty ratio high and eliminate the need to operate the circuit at high speed, thereby reducing power consumption.

What is claimed is:

1. A method of driving a light emitting device comprising a plurality of pixels, a plurality of source signal lines and a plurality of gate signal lines, the method comprising:

inputting a first data signal having a first one of n, wherein n is a natural number equal to or larger than 4, different levels of potential to one of the plurality of pixels through one of the plurality of source signal lines in a first sub-frame period; and inputting a second data signal having a second one of n, wherein n is a natural number equal to or larger than 4, different levels of potential to the one of the plurality of pixels through the one of the plurality of source signal lines in a second sub-frame period, wherein one frame period has m, wherein m is a natural number equal to or larger than 2, sub-frame periods comprising the first sub-frame period and the second sub-frame period.

2. A method of driving a light emitting device according to claim 1, wherein a light emitting element is placed in the one of the plurality of pixels, wherein the light emitting element has a first electrode and a second electrode, and wherein a light emission luminance of the light emitting element is controlled by a current that flows between the first electrode and the second electrode depending on data signals inputted to the one of the plurality of pixels.

3. A method of driving a light emitting device according to claim 1, wherein the one frame period has a period in which a bias voltage of a polarity reverse to a forward polarity is applied to the light emitting element.

4. An electronic equipment employing the light emitting device driving method of claim 1.

5. A method of driving a light emitting device according to claim 1, wherein a gray scale level of the light emitting device depends on both a selection of sub-frame periods from the m sub-frame periods and luminance level of the light emitting element in each of m sub-frame periods.

6. A method of driving a light emitting device according to claim 1, wherein a length of the first sub-frame period is different from a length of the second sub-frame period.

7. A method of driving a light emitting device according to claim 1, wherein number of gray scale levels of the light emitting device is larger than $2^m$.

8. A method of driving a light emitting device with one frame period having m, wherein m is a natural number equal to or larger than 2, different sub-frame periods, each of the m different sub-frame periods having an address period and a sustain period, comprising:

inputting an analog data signal having n, wherein n is a natural number equal to or larger than 4, different levels of potential to a source signal line during the address period, emitting light from a light emitting element at n different levels of luminance in response to the analog data signal during the sustain period, and wherein an image is displayed in $n^m$ gray scales by the light emitting device.

9. A method of driving a light emitting device according to claim 8, wherein the light emitting element is placed in a pixel portion, wherein the light emitting element has a first electrode and a second electrode, and wherein a light emission luminance of the light emitting element is controlled by a current that flows between the first electrode and the second electrode depending on the analog data signal.

10. A method of driving a light emitting device according to claim 8, wherein the one frame period has a period in which a bias voltage of a polarity reverse to a forward polarity is applied to the light emitting element.

11. An electronic equipment employing the light emitting device driving method of claim 8.

12. A method of driving display device comprising:

inputting a first data signal having a first one of n, wherein n is a natural number equal to or larger than 4, different levels of potential to a pixel through a source signal line in a first sub-frame period, inputting a second data signal having a second one of n, wherein n is a natural number equal to or larger than 4, different levels of potential to the pixel through the source signal line in a second sub-frame period, and wherein one frame period has m, wherein m is a natural number equal to or larger than 4, a sub-frame periods comprising the first sub-frame period and the second sub-frame period, and wherein the pixel comprises a transistor, and each of the first data signal and the second data signal is inputted to the pixel through the transistor and the source signal line.

13. A method of driving a light emitting device according to claim 12, wherein a length of the first sub-frame period is different from a length of the second sub-frame period.

14. A method of driving a light emitting device according to claim 12, wherein number of gray scale levels of the light emitting device is larger than $2^m$.

* * * * *